US005667288A

United States Patent [19]

Kang

[11] Patent Number: 5,667,288

[45] Date of Patent: Sep. 16, 1997

[54] APPARATUS FOR COLLECTING ROLL FILM

[76] Inventor: Shih-Chang Kang, No. 125-1, Section 1, San Min Road, West District, Taichung, Taiwan

[21] Appl. No.: 492,183

[22] Filed: Jun. 19, 1995

[51] Int. Cl.[6] ..... A47G 29/00

[52] U.S. Cl. ..... 312/211; 232/44

[58] Field of Search ..... 312/211; 232/44; 109/24.1, 66

[56] References Cited

U.S. PATENT DOCUMENTS

| | | | |
|---|---|---|---|
| 1,966,705 | 7/1934 | Bremer | 232/44 |
| 2,572,003 | 10/1951 | Binns et al. | 109/24.1 |
| 2,769,516 | 11/1956 | Hensley, Jr. | 232/44 |

*Primary Examiner*—Peter M. Cuomo
*Assistant Examiner*—Gerald A. Anderson
*Attorney, Agent, or Firm*—Charles E. Baxley, Esq.

[57] ABSTRACT

An apparatus for collecting roll films to be developed includes a housing having an opening formed in the front portion. A barrel is rotatably supported in the housing and has an orifice for aligning with the opening and for allowing insertion of the roll film into the barrel. The barrel may enclose the opening when the orifice is disengaged from the opening. The housing includes a pair of channels for guiding a roller and the barrel to move up and down. A roll of strip material is supported in the housing and has an end engaged between the roller and the barrel so as to be sent out of the housing via a slit.

6 Claims, 5 Drawing Sheets

APPARATUS FOR COLLECTING ROLL FILM

BACKGROUND OF THE INVENTION

1. Field of the Invention

The present invention relates to an apparatus, and more particularly to an apparatus for collecting roll films.

2. Description of the Prior Art

Typically, the roll films to be developed are received in an envelope and are disposed in a large container which is provided for collecting the roll film. However, the roll films are not suitably protected and may be easily stolen.

The present invention has arisen to mitigate and/or obviate the afore-described disadvantages of the conventional roll film collecting problems.

SUMMARY OF THE INVENTION

The primary objective of the present invention is to provide an apparatus which may easily and safely collect the roll films.

In accordance with one aspect of the invention, there is provided an apparatus for collecting roll films comprising a housing including a front panel having an opening and a slit formed therein and including a hollow interior, means for enclosing the opening, and means for rotating the enclosing means so as to open the opening and so as to collect the roll films via the opening.

The enclosing means includes a barrel rotatably supported in the housing and having an orifice for aligning with the opening of the housing, the barrel is rotated by the rotating means so as to align the orifice thereof with the opening for allowing insertion of the roll fill into the barrel, the barrel encloses the opening when the orifice is disengaged from the opening.

The housing includes a pair of channel means provided therein, and includes a roller having end portions slidably engaged in the channel means and movable up and down along the channel means, the enclosing means includes a barrel engaged above the roller and having end portions slidably engaged in the channel means and movable up and down along the channel means, the enclosing means includes a biasing means for biasing the roller to engage with the barrel.

The barrel includes a first pulley secured thereto, the rotating means includes a motor having a second pulley secured thereto and includes a belt means for coupling the first and second pulleys together so as to rotate the barrel by the motor.

A roll of strip material is supported in the housing, the strip material includes a first end engaged between the roller and the barrel so as to be sent out of the housing via the slit.

A casing is secured in the housing and arranged below the barrel for collecting the roll fill from thre barrel. The housing may include a rear door for enclosing the rear portion of the housing and for opening the rear portion of the housing so as to allow entering into the housing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
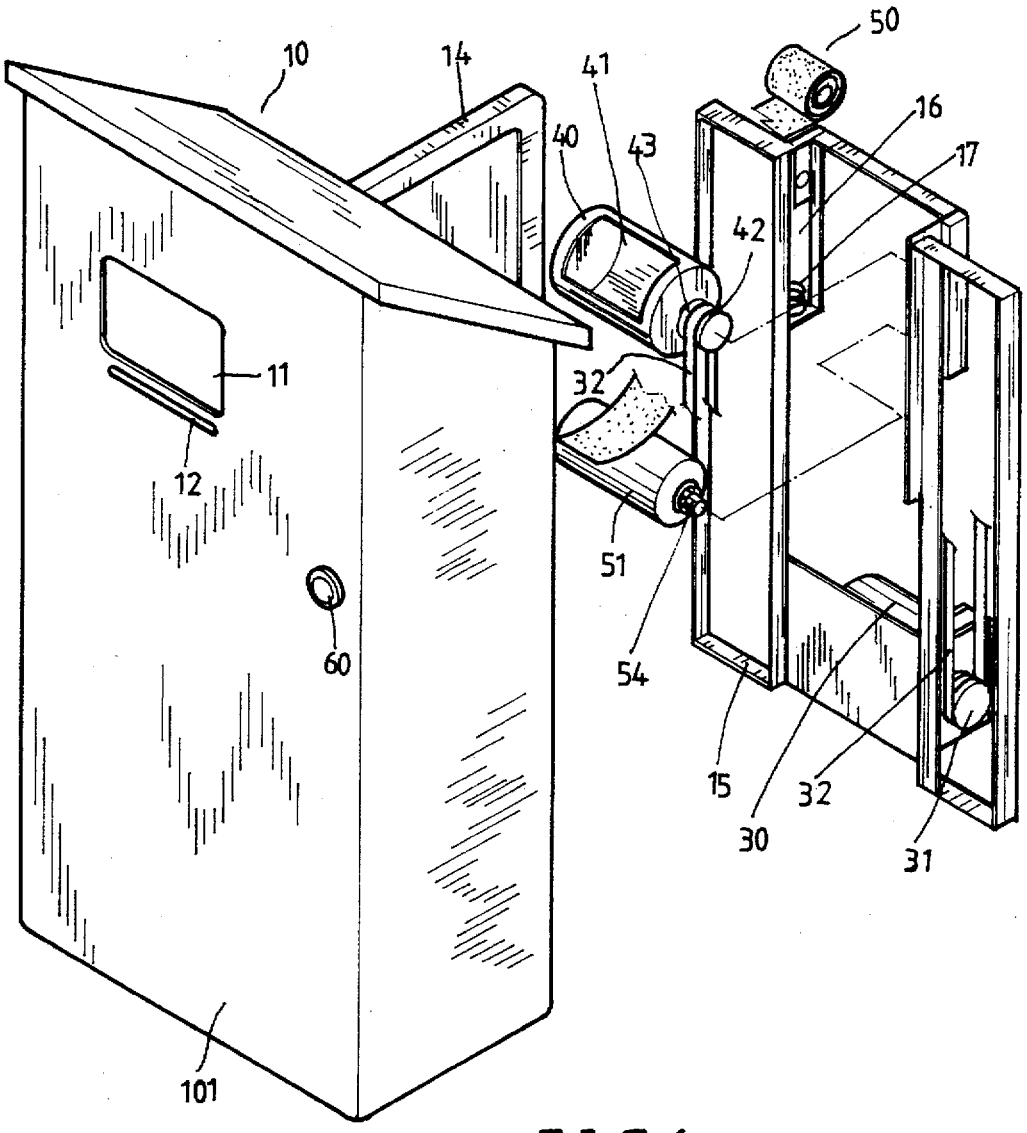
FIG. 1 is an exploded perspective view of an apparatus for collecting roll film in accordance with the present invention.
Figure 2:
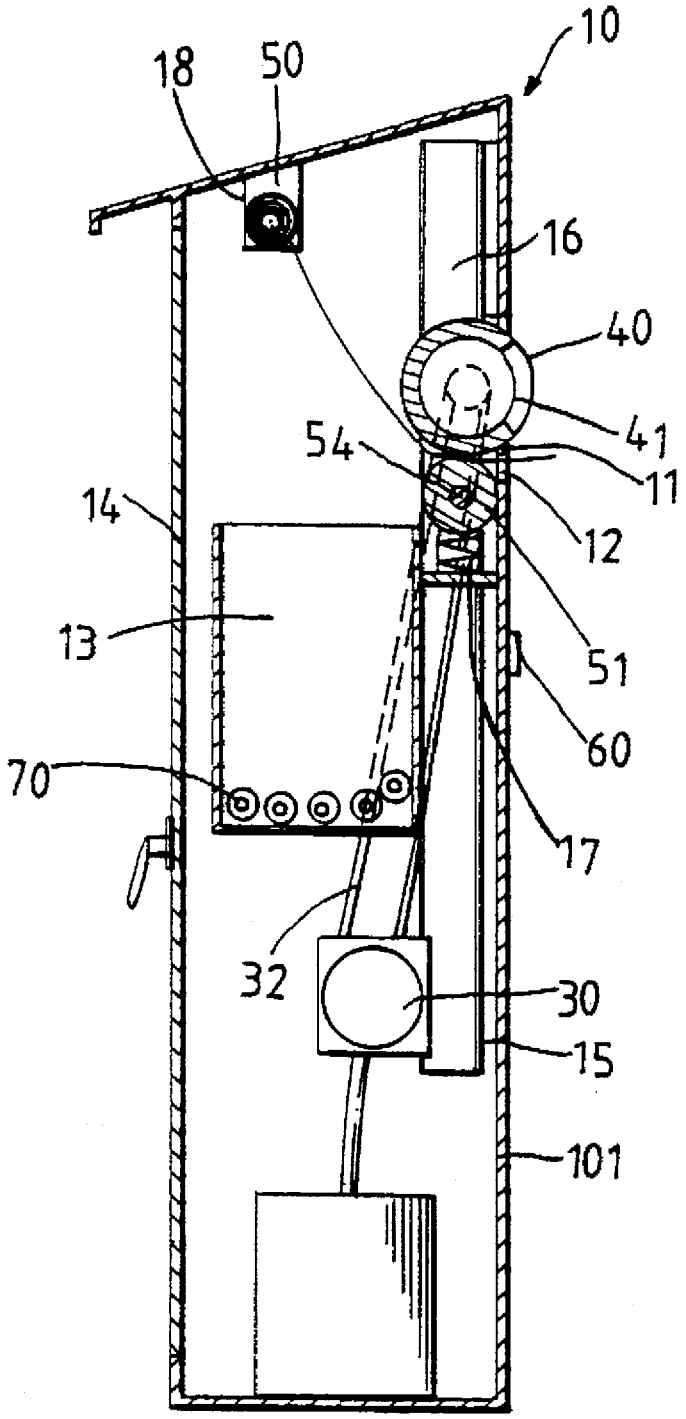
FIGS. 2 and 3 are cross sectional views illustrating the operation of the apparatus.

Referring to FIGS. 1 and 2, an apparatus for collecting roll film in accordance with the present invention comprises a housing 10 including a front panel 101 having an opening 11 and a slit 12 formed in the upper portion and including a rear door 14 pivotally coupled to the rear portion for enclosing the rear portion of the housing 10. A lock means may be provided for locking the rear door 14 to the housing 10 so as to prevent unthorized persons from entering into the housing 10.

A frame 15 is engaged in the housing 10 and secured to the front panel 101. The frame 15 includes a pair of vertical channels 16 formed in the upper portion and aligned with the opening 11 and the slit 12. Two spring means 17 are engaged in the bottom portion of the channel 16. A roller 51 includes two studs 54 laterally extended outward therefrom for slidably engaging in the channels 16 of the frame 15 such that the roller 51 is movable up and down along the channels 16. The studs 54 are engaged with the spring means 17. A barrel 40 includes an orifice 41 formed therein for aligning with the opening 11 of the housing 10 and includes a pair of projections 43 laterally extended outward therefrom for slidably engaging in the channels 16 of the frame 15 such that the barrel 40 is movable up and down along the channels 16. The barrel 40 is located above the roller 51 and engaged with the roller 51. A pulley 42 is secured to one of the projections 43 for engaging with a belt 32. A reversible motor 30 is disposed in the bottom portion of the frame 15 and includes a pulley 31 secured thereto for engaging with the belt 32, such that the barrel 40 may be rotated by the motor 30.

Figure 3:
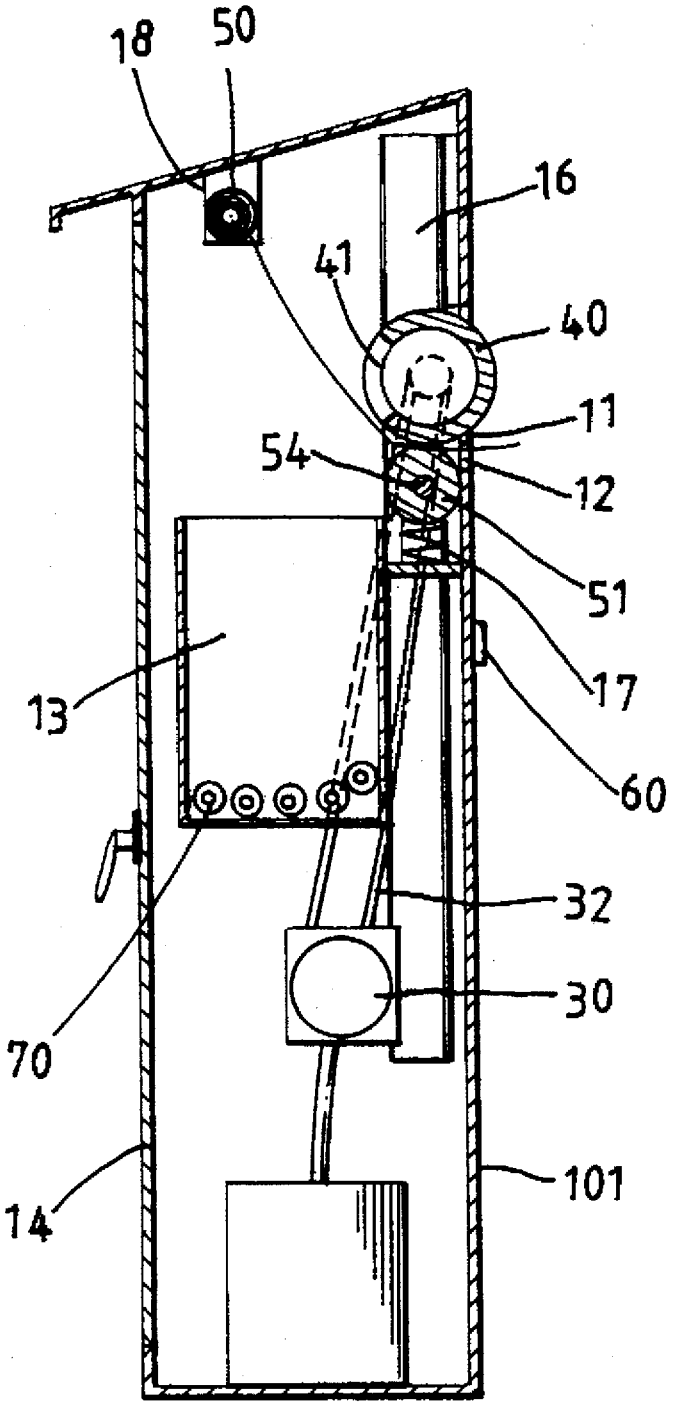

As shown in FIGS. 2 and 3, the barrel 40 may be rotated by the motor 30 so as to align the orifice 41 of the barrel 40 with the opening 11 of the housing 10 such that the roll films to be developed may be disposed into the barrel 40 via the opening 11 and the orifice 41, best shown in FIG. 2. The barrel 40 may also be rotated by the motor 30 so as to disengage the orifice 41 from the opening 11, best shown in FIG. 3, such that the roll film received in the barrel 40 may be disengaged from the barrel 40 via the orifice 41. A casing 13 is secured in the housing 10 or secured to the frame 15, and is located below the barrel 40 for collecting the roll film 70 disengaged from the barrel 49. When the orifice 41 is disengaged from the opening 11, the opening may be enclosed by the barrel 40.

The housing 10 includes a bracket 18 secured to the upper portion for supporting a roll of strip material 50. One end of the strip material 50 is engaged between the roller 51 and the barrel 40 such that the strip material 50 may be sent out of the housing 10 via the slit 12 when the barrel 40 is rotated by the motor 30. The strip material 50 may include a number of envelopes which may be used for packaging the roll film and for making notes, and may include a number of receipts for the users. A button 60 is provided in the front panel 101 for controlling the motor 30. A coin receiving means may further be provided for energizing the motor 30 before the button 60 is depressed.

Figure 4:
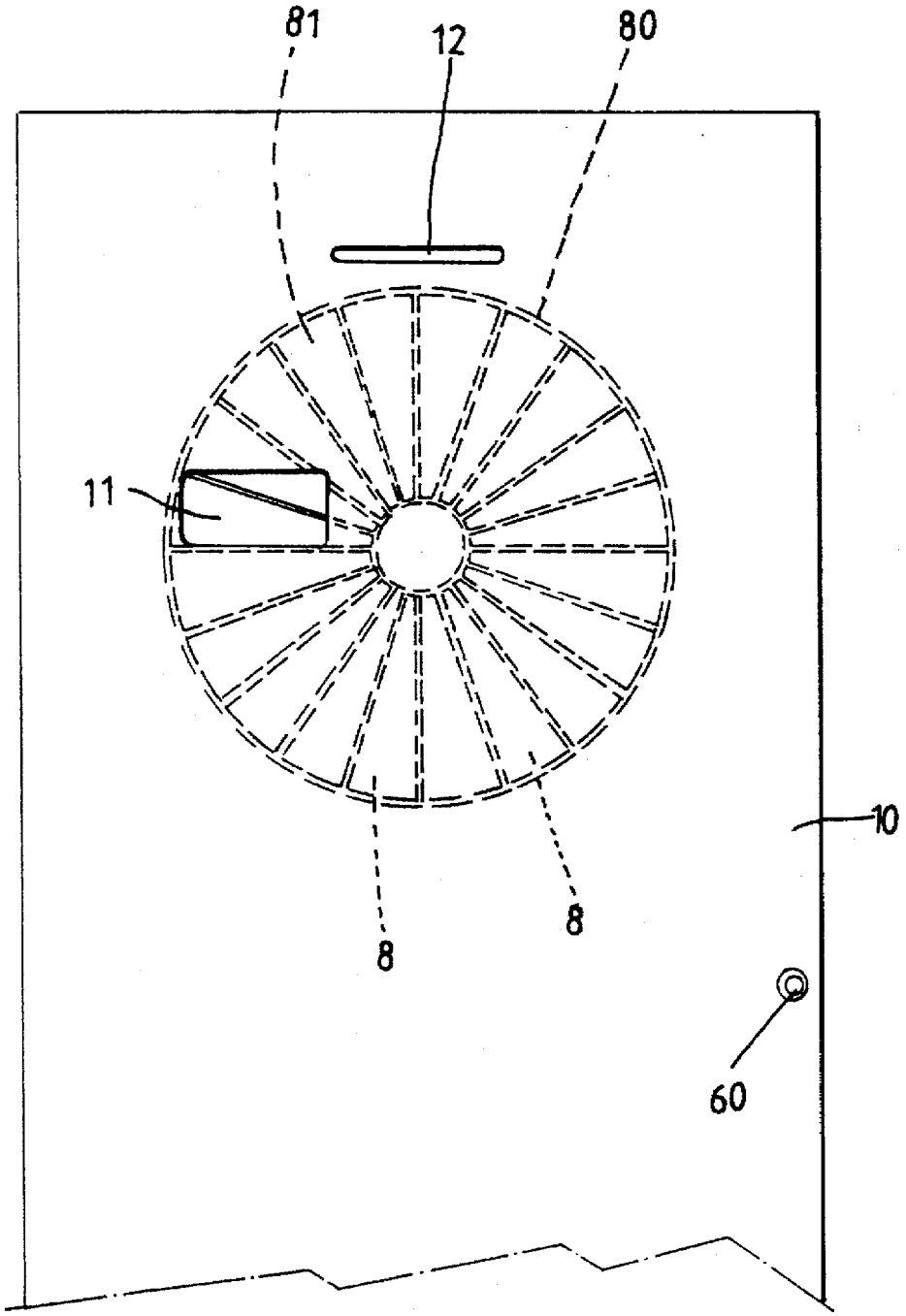
FIG. 4 is a schematic view illustrating another embodiment of the roll film receiving means.

Alternatively, as shown in FIG. 4, the barrel may be replaced by a rotary box 80 which includes a number of cavities 81 formed therein for aligning with the opening 11 of the housing 10 and for receiving the roll film 70. The slit 12 is disengaged from the rotary box 80. The rotary box 80 may also be rotated by the motor 30.

Figure 5:
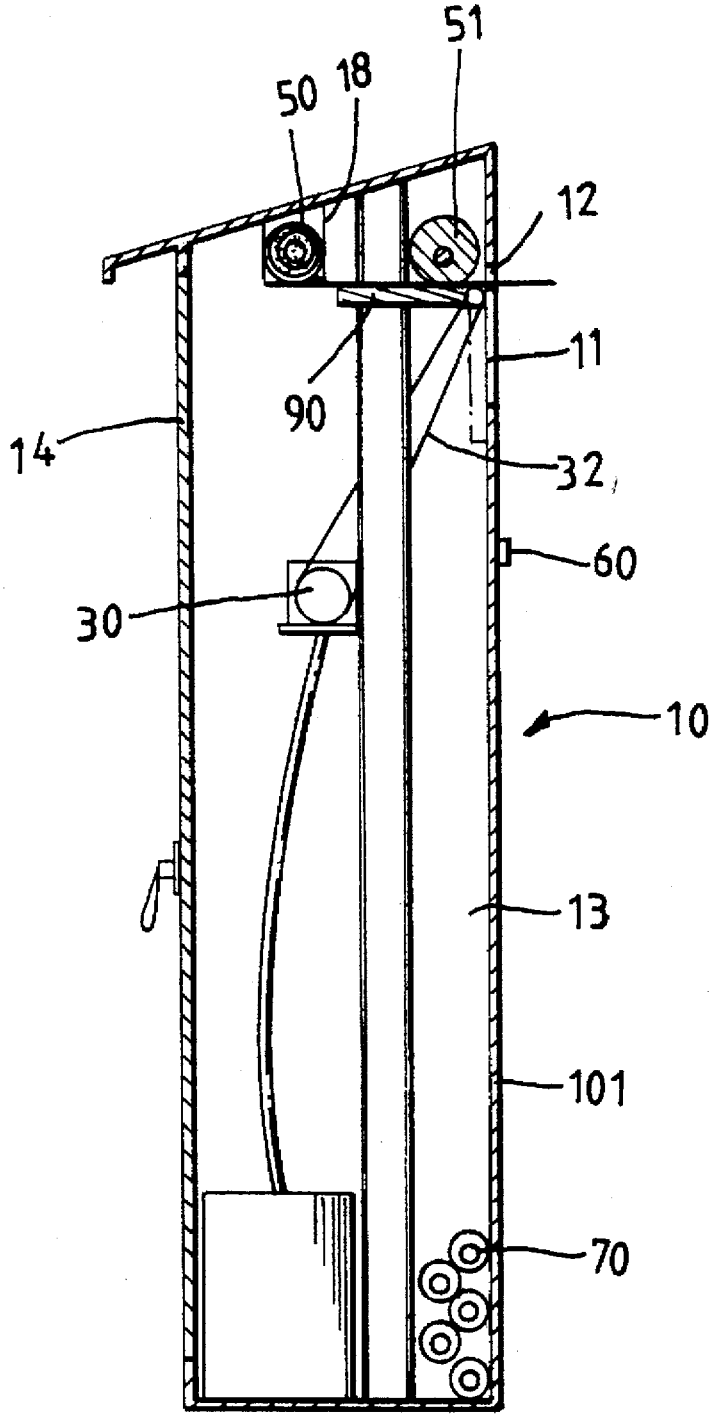
FIG. 5 is a cross sectional view similar to FIGS. 2 and 3, illustrating another embodiment of the roll film collecting apparatus.

Further alternatively, as shown in FIG. 5, a cover 90 may be pivotally coupled to the housing 10 by a pivot shaft 12 which is coupled to the motor 30 by the belt 32 such that the cover 90 lay be rotated by the motor 30 in order to enclose the opening 11 of the housing 10. The strip material 50 may also be sent out of the housing 10 via the slit 12 by the roller 51. The roll films 70 may be directly collected in the housing 10.

Accordingly, the apparatus in accordance with the present invention includes configuration that may easily and safely collect the roll films to be developed.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An apparatus for collecting roll films comprising:

a housing including a front panel having an opening and a slit and including a hollow interior, said housing including a pair of channel means and including a roller having end portions slidably engaged in said channel means for moving along said channel means, means for enclosing said opening, said enclosing means including a barrel having end portions slidably engaged in said channel means for moving along said channel means, said barrel being located above said roller, said enclosing means including a biasing means for biasing said roller to engage with said barrel, and means for rotating said barrel of said enclosing means so as to open said opening and so as to collect the roll films via said opening.

2. An apparatus according to claim 1, wherein said barrel includes an orifice for aligning with said opening of said housing, said barrel is rotated by said rotating means so as to align said orifice with said opening for allowing insertion of the roll film into said barrel, said barrel encloses said opening when said orifice is disengaged from said opening.

3. An apparatus according to claim 1 further comprising a casing secured in said housing and arranged below said barrel for collecting the roll film from said barrel.

4. An apparatus according to claum 1, wherein said barrel includes a first pulley secured thereto, said rotating means includes a motor having a second pulley secured thereto and includes a belt means for coupling said first and second pulleys together so as to rotate said barrel by said motor.

5. An apparatus according to claim 1 further comprising a roll of strip materials supported in said housing, said strip materials including a first end engaged between said roller and said barrel so as to be sent out of said housing via said slit.

6. An apparatus according to claim 1 further comprising a rear portion having a door pivotally coupled thereto.

* * * * *